US010400551B2

(12) United States Patent
Murr et al.

(10) Patent No.: US 10,400,551 B2
(45) Date of Patent: Sep. 3, 2019

(54) SYSTEM AND METHOD FOR PREDICTING WELL SITE PRODUCTION

(71) Applicants: David Murr, Minneapolis, MN (US); Shadrian Strong, Catonsville, MD (US); Kristin Lavigne, Lincoln, MA (US); Lars Dyrud, Crownsville, MD (US); Jonathan Fentzke, Arlington, VA (US)

(72) Inventors: David Murr, Minneapolis, MN (US); Shadrian Strong, Catonsville, MD (US); Kristin Lavigne, Lincoln, MA (US); Lars Dyrud, Crownsville, MD (US); Jonathan Fentzke, Arlington, VA (US)

(73) Assignee: OmniEarth, Inc., Arlington, VA (US)

( * ) Notice: Subject to any disclaimer, the term of this patent is extended or adjusted under 35 U.S.C. 154(b) by 113 days.

(21) Appl. No.: 15/041,175

(22) Filed: Feb. 11, 2016

(65) Prior Publication Data

US 2016/0282508 A1 Sep. 29, 2016

Related U.S. Application Data

(60) Provisional application No. 62/139,386, filed on Mar. 27, 2015.

(51) Int. Cl.
*E21B 43/00* (2006.01)

(52) U.S. Cl.
CPC ..... *E21B 43/00* (2013.01)

(58) Field of Classification Search
CPC ..... E21B 43/00
See application file for complete search history.

(56) References Cited

U.S. PATENT DOCUMENTS

2004/0108110 A1* 6/2004 Zupanick ..... B65G 5/00 166/245
2012/0109597 A1* 5/2012 Derfoul ..... E21B 43/00 703/2
2014/0002667 A1* 1/2014 Cheben ..... G01N 21/3518 348/164
2014/0336953 A1* 11/2014 Johnson ..... G01N 21/538 702/24
2014/0379317 A1* 12/2014 Sanden ..... E21B 43/00 703/10

OTHER PUBLICATIONS

EPA published handbook on remote optical sensing for monitoring and measuring gaseous emission, (published Dec. 2011).*

(Continued)

*Primary Examiner* — Yasser A Abdelaziez
(74) *Attorney, Agent, or Firm* — Dunlap Codding, P.C.

(57) ABSTRACT

A device includes an image data receiving processor, a well site data receiving processor, a zonal statistics processor and a vent flare calculator. The image data receiving processor receives image data of a geographic region around and including a well site. The well site data receiving processor receives well site location data of a location of the well site and generates well pad location data of a location of a well pad including the well site. The zonal statistics processor generates pixel data from the well pad location. The vent flare calculator calculates a volume of flared gas and based on the pixel data.

14 Claims, 23 Drawing Sheets

(56) References Cited

OTHER PUBLICATIONS

Turcotte et al. ("Gas Plume Quantification in Downlooking Hyperspectral Longwave Infrared Images," SPIE Proceedings vol. 7830, Image and Signal Processing for Remote Sensing XVI; 78300D, 2010), (Year: 2010).*

Pogorzala et al. ("Gas plume species identification by regression analyses," Algorithms and Technologies for Multispectral, Hyperspectral, and Ultraspectral Imagery X, Proceedings of SPIE vol. 5425, pp. 583-591, 2004) (Year: 2004).*

Emam, Eman, "Gas Flaring in Industry: An Overview", Petroleum & Coal Journal, vol. 57, Issue 5, pp. 532-555, 2015.

Elvidge et al., "Methods for Global Survey of Natural Gas Flaring from Visible Infrared Imaging Radiometer Suite Data", *Energies* 9, No. 1:14, Dec. 25, 2015.

Clearstone Engineering Ltd., "Estimation of Flaring and Venting Volumes from Upstream Oil and Gas Facilities," Canadian Association of Petroleum Producers, May 2002.

* cited by examiner

SYSTEM AND METHOD FOR PREDICTING WELL SITE PRODUCTION

The present application claims priority from: U.S. Provisional Application No. 62/139,386 filed Mar. 27, 2015, the entire disclosure of which is incorporated herein by reference.

BACKGROUND

The present invention generally deals with systems and method of predicting well site production.

There exists a need to provide an improved system and method of predicting well site production.

SUMMARY

The present invention provides an improved method and apparatus of predicting well site production.

Various embodiments described herein are drawn to a device that includes an image data receiving processor, a well site data receiving processor, a zonal statistics processor and a vent flare calculator. The image data receiving processor receives image data of a geographic region around and including a well site. The well site data receiving processor receives well site location data of as location of the well site and generates well pad location data of a location of a well pad including the well site. The zonal statistics processor generates pixel data from the well pad location. The vent flare calculator calculates a volume of flared gas and based on the pixel data.

BRIEF SUMMARY OF THE DRAWINGS

The accompanying drawings, which are incorporated in and form a part of the specification, illustrate an exemplary embodiment of the present invention and, together with the description, serve to explain the principles of the invention. In the drawings.

DETAILED DESCRIPTION

Aspects of the present invention are drawn to a system and method for predicting well site production.

Satellite imager is conventionally used to determine many parameters. In accordance with aspects of the present invention, satellite imagery is used to predict well site production.

A system and method for predicting well site production will now be described with reference to FIGS. 1-16.

Figure 1:
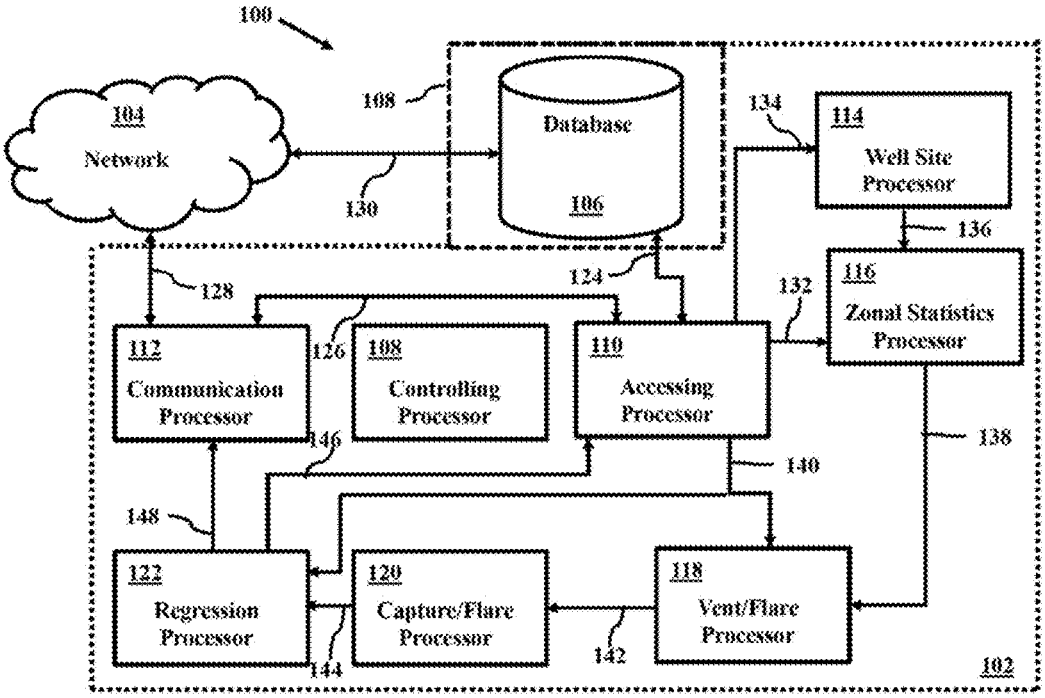
FIG. 1 illustrates an example system for predicting well site production in accordance with aspects of the present invention.

FIG. 1 illustrates an example system 100 for predicting well site production in accordance with aspects of the present invention.

As shown in the figure, system 100 includes well site production processor 102 and a network 104. Well site production processor 102 includes a database 106, a controlling processor 108, an accessing processor 110, a communication processor 112, a well site processor 114, a zonal statistics processor 116, a vent/flare processor 118, a capture/flare processor 120 and a regression processor 122.

In this example, database 106, controlling processor 108, accessing processor 110, communication processor 112, well site processor 114, zonal statistics processor 116, vent/flare processor 118, capture/flare processor 120 and predictive processor 120 are illustrated as individual devices. However, in some embodiments, at least two of database 106, controlling processor 108, accessing processor 110, communication processor 112, well site processor 114, zonal statistics processor 116, vent/flare processor 118, capture/hare processor 120 and predictive processor 120 may be combined as a unitary device.

Further, in some embodiments, at least one of database 106, controlling processor 108, accessing processor 110, communication processor 112, well site processor 114, zonal statistics processor 116, vent/flare processor 118, capture/flare processor 120 and predictive processor 120 may be implemented as a processor working in conjunction with a tangible processor-readable media for carrying, or having processor-executable instructions or data structures stored thereon. Non-limiting examples of tangible processor-readable media include physical storage and/or memory media such as RAM, ROM, EEPROM, CD-ROM or other optical disk storage, magnetic disk storage or other magnetic storage devices, or any other medium which can be used to carry or store desired program code means in the form of processor-executable instructions or data structures and which can be accessed by special purpose computer. For information transferred or provided over a network or another communications connection (either hardwired, wireless, or a combination of hardwired or wireless) to a computer, the processor may properly view the connection as a processor-readable medium. Thus, any such connection may be properly termed a processor-readable medium. Combinations of the above should also be included within the scope of processor readable media.

Controlling processor 108 is in communication with each of accessing processor 110, communication processor 112, well site processor 114, zonal statistics processor 116, vent/flare processor 118, capture/flare processor 120 and regression processor 122 by communication channels (not shown). Controlling processor 108 may be any device or system that is able to control operation of each of accessing processor 110, communication processor 112, well site processor 114, zonal statistics processor 116, vent/flare processor 118, capture/flare processor 120 and regression processor 122.

Accessing processor 110 is arranged to bi-directionally communicate with database 106 via a communication channel 124 and is arranged to hi-directionally communicate with communication processor 112 via a communication channel 126. Accessing processor 110 is additionally arranged to communicate with well site processor 114 via a communication channel 134, to communicate with zonal statistics processor 116 via a communication channel 132 and to communicate with vent/flare processor 118 and regression processor 122 via a communication channel 140. Accessing processor 110 may be any device or system that is able to access data within database 106 directly via communication channel 124 or indirectly, via communication channel 126, communication processor 112, a communication channel 128, network 104 and a communication channel 130.

Communication processor 112 is additionally arranged to bi-directionally communicate with network 104 via communication channel 128. Communication processor 112 may be any device or system that is able to bi-directionally communicate with network 104 via communication channel 128.

Network 104 is additionally arranged to hi-directionally communicate with database 106 via communication channel 130. Network 104 may be any of known various communication networks, non-limiting examples of which include a Local Area Network (LAN), a Wide Area Network (WAN), a wireless network and combinations thereof. Such networks may support telephony services for a mobile terminal to communicate over a telephony network (e.g., Public Switched Telephone Network (PSTN). Non-limiting example wireless networks include a radio network that supports a number of wireless terminals, which may be fixed or mobile, using various radio access technologies. According to some example embodiments, radio technologies that can be contemplated include: first generation (1G) technologies (e.g., advanced mobile phone system (AMPS), cellular digital packet data (CDPD), etc.), second generation (2G) technologies (e.g., global system for mobile communications (GSM), interim standard 95 (IS-95), etc.), third generation (3G) technologies (e.g., code division multiple access 2000 (CDMA2000), general packet radio service (GPRS), universal mobile telecommunications system (UMTS), etc.), 4G, etc. For instance, various mobile communication standards have been introduced such as first generation (1G) technologies (e.g., advanced mobile phone system (AMPS), cellular digital packet data (CDPD), etc.), second generation (2G) technologies (e.g., global system for mobile communications (GSM), interim standard 95 (IS-95), etc.), third generation (3G) technologies (e.g., code division multiple access 2000 (CDMA2000), general packet radio service (GARS), universal mobile telecommunications system (UMTS), etc.), and beyond 3G technologies (e.g., third generation partnership project (3GPP) long term evolution (3GPP LTE), 3GPP2 universal mobile broadband (3GPP2 UMB), etc.).

Complementing the evolution in mobile communication standards adoption, other radio access technologies have also been developed by various professional bodies, such as the Institute of Electrical and Electronic Engineers (IEEE), for the support of various applications, services, and deployment scenarios. For example, the IEEE 1102.11 standard, also known s wireless fidelity (WiFi), has been introduced for wireless local area networking, while the IEEE 1102.16 standard, also known as worldwide interoperability for microwave access (WiMAX) has been introduced for the provision of wireless communications on point-to-point links, as well as for fill mobile access over longer distances. Other examples include Bluetooth™, ultra-wideband (UWB), the IEEE 1102.22 standard, etc.

Well site processor 114 is additionally arranged to communicate with zonal statistics processor 116 via a communication channel 136. Well site processor 114 may be any device or system that is able to receive well site location data of a location of a well site and to generate well pad location data of a location of a well pad including the well site.

Zonal statistics processor 116 is additionally arranged to communicate with vent/flare processor 118 via a communication channel 138. Zonal statistics processor 116 may be any device or system that is able to delineate data in a zonal basis. For example, zonal statistics processor 116 may provide data based on country boundaries, state boundaries, county boundaries, city boundaries, town boundaries, land plot boundaries, etc.

Vent/flare processor 118 is additionally arranged to communicate with capture/flare processor 120 via a communication channel 142. Within as well site, by-product gaseous flammable hydrocarbons may be vented for capture or flaring. In some cases, it is more cost effective to just flare, i.e., ignite—thus causing a flare, the vented by-product gaseous flammable hydrocarbons. Vent/flare processor 118 may be any device or system that is able to determine an amount of vented, gaseous, flammable hydrocarbons based on an imaged flare.

Capture/flare processor 120 is additionally arranged to communicate with regression processor 122 via a communication channel 144. Capture/flare processor 120 may be any device or system that is able to determine an amount of captured crude oil based on an amount of flared, vented, by-product, gaseous, flammable hydrocarbons.

Regression processor 122 is additionally arranged to communicate with communication processor 112 via a communication channel 148. Regression processor 122 may be any device or system that is able to modify weighting factors to generate curve fitting functions that model historical actual volumes of crude captured from a well site and that predict future volumes of crude captured from the well site.

Communication channels 124, 126, 128, 130, 132, 134, 136, 138, 140, 142, 144, 146 and 148 may be any known wired or wireless communication channel.

Operation of system 100 will now be described with reference to FIGS. 2-16.

Figure 2:
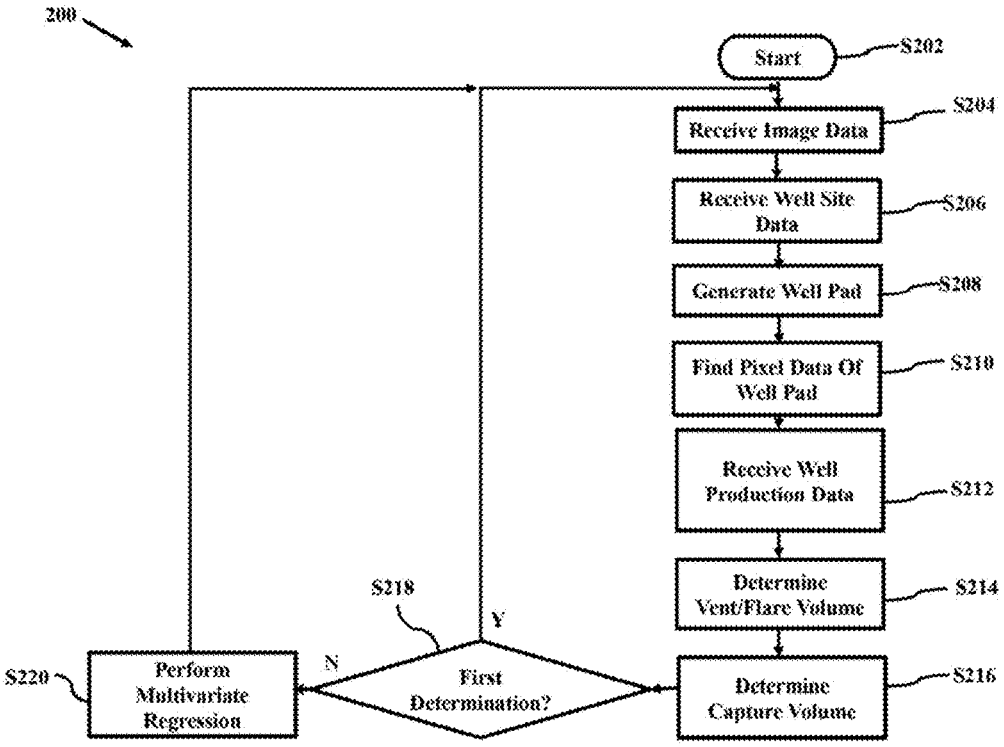
FIG. 2 illustrates an example method 200 of predicting well site production in accordance with aspects of the present invention.

FIG. 2 illustrates an example method 200 of predicting well site production in accordance with aspects of the present invention.

As shown in the figure, method 200 starts (S202) and image data is received (S204). For example, as shown in FIG. 1, accessing processor 110 retrieves image data from database 106. In some embodiments, accessing processor 110 may retrieve the image data directly from database 106 via communication channel 124. In other embodiments, accessing processor 110 may retrieve the image data from database 106 via a path of communication channel 126, communication processor 112, communication channel 128, network 104 and communication channel 130.

Database 106 may have various types of data stored therein. This will be further described with reference to FIG. 3.

Figure 3:
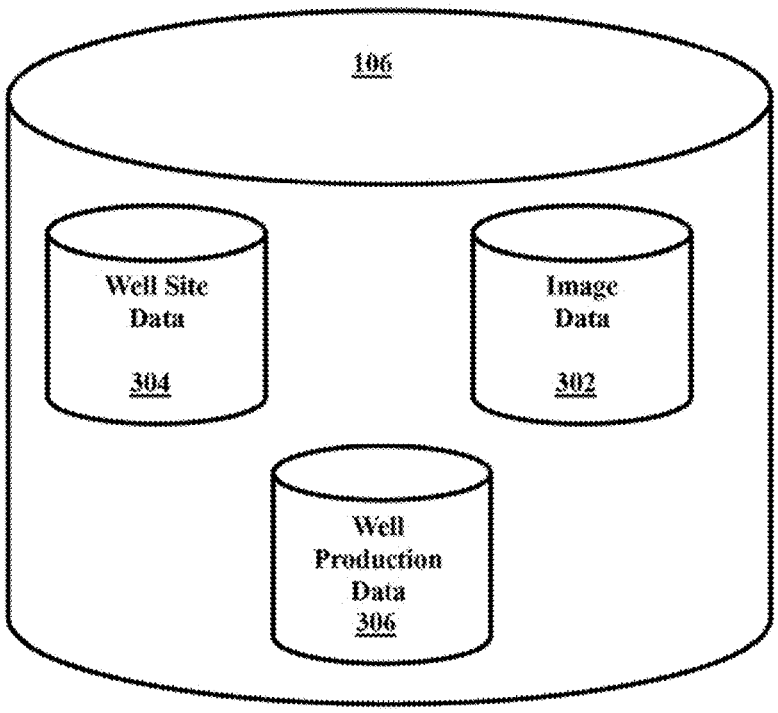
FIG. 3 illustrates an example of the database of FIG. 1.

FIG. 3 illustrates an example of database 106 of FIG. 1.

As shown in FIG. 3, database 106 includes an image data database 302, a well site data database 304 and a well production data databases 306.

In this example, image data database 302, well site data database 304 and well production data database 306 are illustrated as individual devices. However, in some embodiments, at least two of image data database 302, well site data database 304 and well production data database 306 may be combined as a unitary device. Further, in some embodiments, at least one of image data database 302, well site data database 304 and well production data database 306 may be implemented as a processor having tangible processor readable media for carrying or having processor-executable instructions or data structures stored thereon.

Image data database 302 includes image data corresponding to an area of land for which well site production is to be estimated. The image data may be provided via a satellite imaging platform. The image data may include a single band or multi-band image data, wherein the image (of the same area of land for which well site production is to be estimated) is imaged in a more than one frequency. In some embodiments, image data may include 4-band image data, which include red, green, blue and near infrared bands (RGB-NIR) of the same area of land for which well site production is to be estimated. In other embodiments, the image data may include more than 4 bands, e.g., hyperspectral image data. The image data comprises pixels, each of which includes respective data values for frequency (color) and intensity (brightness). The frequency may include a plurality of frequencies, based on the number of bands used in the image data. Further, there may be a respective intensity value for each frequency value.

Well site data database 304 includes geodetic data, e.g., latitude and longitude data, of a well site and attributes associated with the well site. Non-limiting examples of attributes associated with a well site include: annual, monthly and daily metrics related to capture volumes; annual, monthly and daily metrics related to types of captures hydrocarbons; equipment types; equipment age; employee number; personal attributes of each employee including years of experience; well site size; well site location; and combinations thereof.

Well production data database 306 includes production data of the well site. This may be provided by government agencies or private companies. Non-limiting examples of production data include data associated with captured crude volume, captured gas volume, flared gas volume, the rate of captured crude, the rate of captured gas and the rate of flared gas.

Returning to FIG. 1, in some cases, database 106 is included in well site production processor 102. However, in other cases, database 106 is separated from well site production processor 102, as indicated by dotted rectangle 108.

As accessing processor 110 will be accessing many types of data from database 106, accessing processor 110 includes many data managing processors. This will be described with greater detail with reference to FIG. 4.

Figure 4:
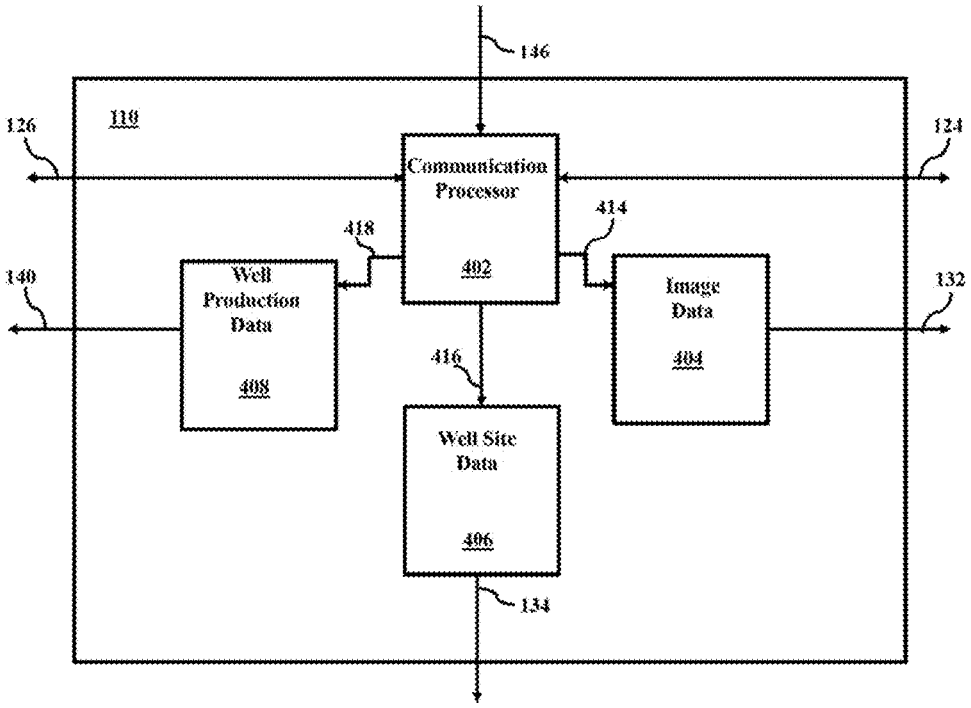
FIG. 4 illustrates an example of the accessing processor of FIG. 1.

FIG. 4 illustrates an example of accessing processor 110 of FIG. 1.

As shown in FIG. 4, accessing processor 110 includes a communication processor 402, an image data receiving processor 404, a well site data receiving processor 406 and a well production data receiving processor 408.

In this example, communication processor 402, image data receiving, processor 404, well site data receiving processor 406 and well production data receiving processor 408 are illustrated as individual devices. However, in some embodiments, at least two of communication processor 402, image data receiving processor 404, well site data receiving processor 406 and well production data receiving processor 408 may be combined as a unitary device. Further, in some embodiments, at least one of communication processor 402, image data receiving processor 404, well site data receiving processor 406 and well production data receiving processor 408 may be implemented as a processor having tangible processor-readable media for carrying or having processor-executable instructions or data structures stored thereon.

Communication processor 402 is arranged to bi-directionally communicate with database 106 via a communication channel 124 and is arranged to bi-directionally communicate with communication processor 112 via a communication channel 126. Communication processor 402 is additionally arranged to communicate with image data receiving processor 404 via a communication channel 414, to communicate with well site data receiving processor 406 via a communication channel 416 and to communicate with well production data receiving processor 408 via a communication channel 418. Communication processor 402 may be any device or system that is able to access data within database 106 directly via communication channel 124 or indirectly, via communication channel 126, communication processor 112, communication channel 128, network 104 and communication channel 130. Image data receiving processor 404, well site data receiving processor 406 and well production data receiving processor 408 may each be any device or system that is able to receive data from communication processor 402 and to output the received data.

Image data receiving processor 404 is additionally arranged to communicate with zonal statistics processor 116 via communication channel 132. Well sue data receiving processor 406 is additionally arranged to communicate with well site processor 114 via communication channel 134. Well production data receiving processor 408 is additionally arranged to communicate with vent/flare processor 118 and regression processor 122 via communication channel 140. Communication channels 414, 416 and 418 may be any known wired or wireless communication channel.

Returning to FIG. 1, accessing processor 110 provides the received image data to zonal statistics processor 116 via communication channel 132. For example, as shown in FIG. 1, accessing processor 110 retrieves image data from database 106. As shown in FIG. 3, database 106 provides the image data from image data database 302. As shown in FIG. 4, communication processor 402 receives the image data from image data database 302 and provides the image data to image receiving processor 404 via communication channel 414. Returning to FIG. 1, image data receiving processor 404 (of accessing processor 110) then provides the image data to zonal statistics processor 116 via communication channel 132.

Returning to FIG. 1, at this point accessing processor 110 has received the image data. An example of such image data will now be described with reference to FIG. 5.

Figure 5A:
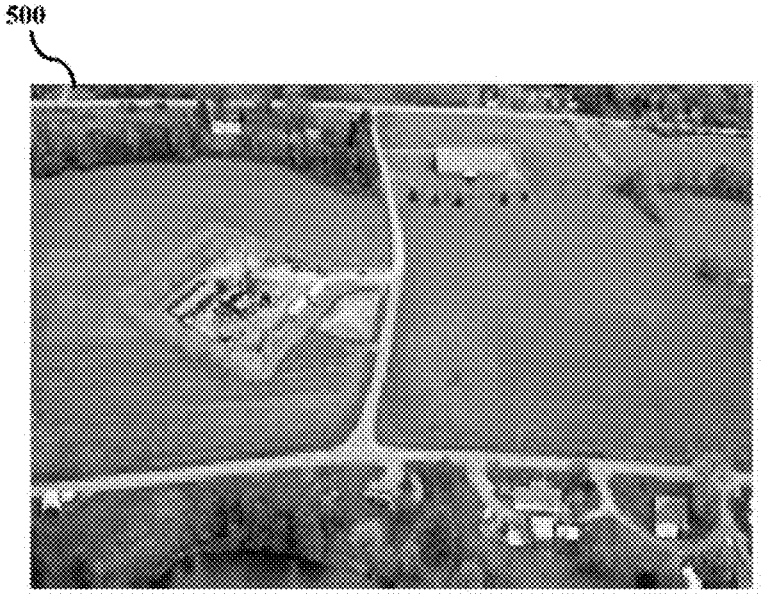
FIG. 5A illustrates a satellite image of a plot of land as imaged in the RGB spectrum.

FIG. 5A illustrates a satellite image 500 of a plot of land as imaged in the RGB spectrum.

Returning to FIG. 2, after the image data is received (S204), the well site data is received (S206). For example, is shown in FIG. 1, accessing processor 110 provides the received well site data to well site processor 114 via communication channel 134. For example, as shown in FIG. 1 accessing processor 110 retrieves well site data from database 106. As shown in FIG. 3, database 106 provides the well site data from well site data database 304. As shown in FIG. 4, communication processor 402 receives the well site data from well site data database 304 and provides the well site data to well site data receiving processor 406 via communication channel 416. Returning to FIG. 1, well site data receiving processor 406 (of accessing processor 110) then provides the well site data to well site processor 114 via communication channel 134.

Returning to FIG. 2, it should be noted that method 200 indicates that the image data is received (S204) prior to the receipt of the well site data (S206). However, this is merely an example embodiment for purposes of explanation. In should be noted that in some embodiments, the well site data may be received prior to receipt of the image data. Further, in some other embodiments, the well site data may be received concurrently with the image data.

In any event, after the image data is received (S204) and the well site data is received (S206), a well pad is generated (S208). For example, as shown in FIG. 1, well site processor 114 extends the area associated with the well site, as provided by the well site data to generate well pad location data of a location of a well pad including the well site, in particular, a well site might include only the site of the well, whereas some flarable gas might escape the well. This flarable gas might flare within some predetermined area around the site of the well. To assure that the flared gas is correctly observed, an area of observation is extended beyond the site of the well. This extended area is the well pad. By using a well pad in accordance with aspects of the present invention, a more accurate evaluation of a gas flare is obtainable, as false positive readings that are outside of the well pad will be ignored.

In some embodiments, the well pad area and location may be fixed and predetermined. In some embodiments, the well pad area and location may be a function of a known detectable parameter.

Well site processor 114 provides the well site location data and the well pad location data to zonal statistics processor 116 via communication channel 136.

Figure 5B:
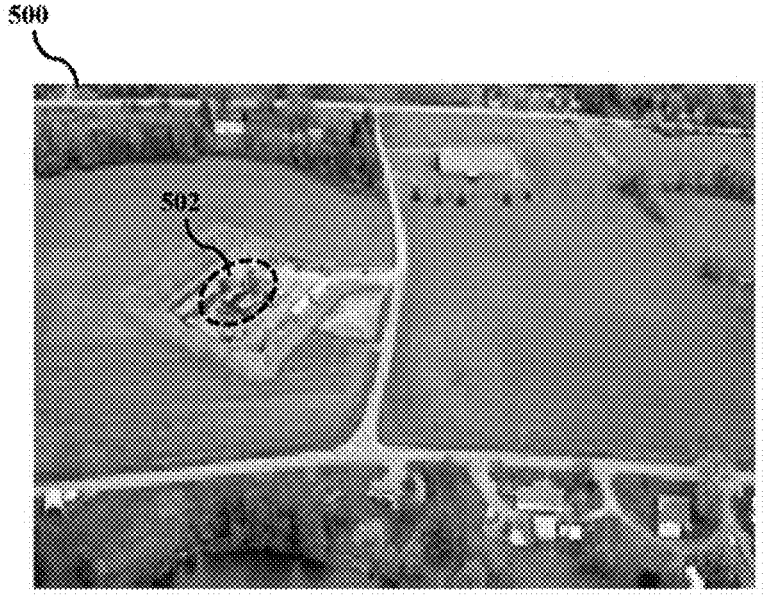
FIG. 5B illustrates the satellite image of FIG. 5A with a well site.

Returning to FIG. 2, after the well pad is generated (S208) the pixel data of the well pad is found (S210). For example, FIG. 5B illustrates satellite image 500 with a well site 502. Here, the well site data identifies the location of well site 502 within satellite image 500. As noted above, the well pad includes well site 502. This will be described with reference to FIG. 6.

Figure 6:
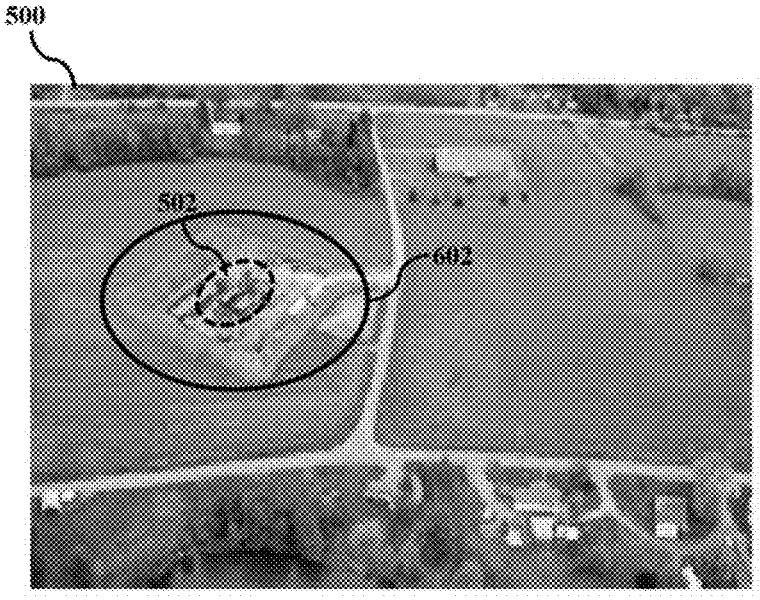
FIG. 6 illustrates the satellite image of FIG. 5B with a well pad as generated in accordance with aspects of the present invention.

FIG. 6 illustrates satellite image 500 with a well pad as generated in accordance with aspects of the present invention. As shown in the figure, well site 502 is circular and is surrounded by a generated well pad 602, which is also circular. The size and shape of a well pad may be predetermined in some embodiments. In other embodiments, the size and shape of a well pad may be a function of some predetermined detectable parameter. As mentioned previously, well pad 602 is generated so as to extend the area of detection around well site 502 for gas flaring. This will be described with additional reference to FIGS. 7A-7D.

FIGS. 7A-D illustrate example images of a well site gas flare, in accordance with aspects of the present invention. In FIGS. 7A-D, a gas flare corresponds to an amount of gasses that are burned at well site 502 at a time $t_1$. The gasses that are burned may include a plurality of different flammable gasses that are extracted from well site 502. The each gas might burn at a different temperature, producing a specific signature, depending on the amount of each as that is burned.

Figure 7A:
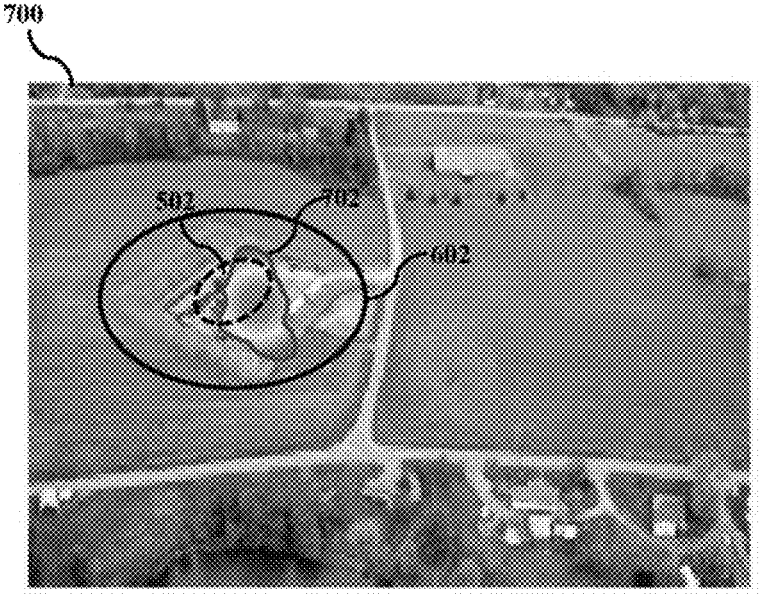
FIG. 7A illustrates an example multi-spectrum image of the plot of land of FIG. 5B at a time $t_1$.

FIG. 7A illustrates an example multi-spectrum image 700 of plot of land 500 of FIG. 5B, at time $t_1$. Multi-spectrum image 700 includes an RGB image of well site 502, of well pad 602 and a multi-spectrum image 702 of a gas flare at time $t_1$.

In this example, some of the gas that is extracted from the well she is burned, resulting in a gas flare. The gas flare may be viewed in the RGB spectrum m addition to the infrared spectrum, thus producing multi-spectrum image 702. If viewed in multiple distinct spectrums, multi-spectrum image 702, will be a composite of images. This will be described with reference to FIGS. 7B-7D.

Figure 7B:
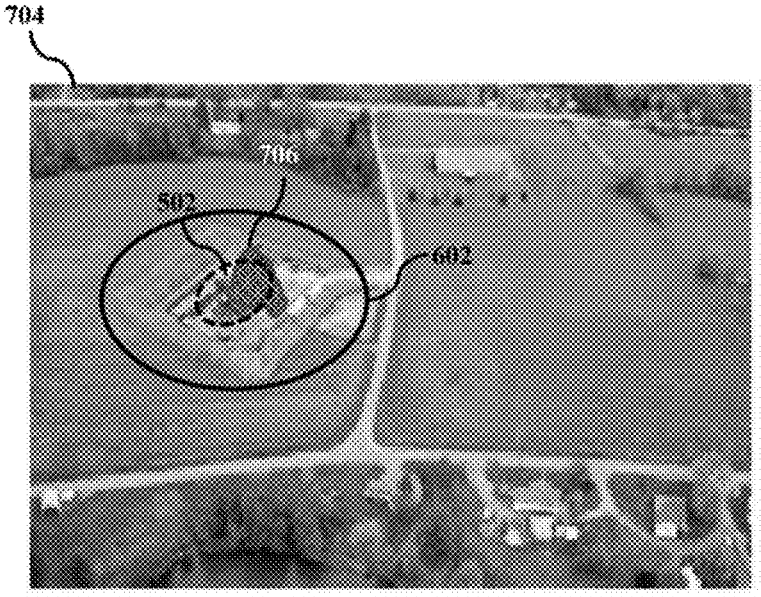
FIG. 7B illustrates an example spectrum image of the plot of land of FIG. 5B.

FIG. 7B illustrates an example spectrum image 704 of plot of land 500 of FIG. 5B. As shown in FIG. 7B, spectrum image 704 includes an RGB image of well site 502, of well pad 602 and a spectrum image 706 of the gas flare in FIG. 7A at a time $t_1$.

In this example embodiment, let spectrum image 706 be an image within a lower portion of the infrared spectrum. In other words, the portion of the gas flare at time $t_1$ that is within a relatively low temperature range shows up as the portion within spectrum image 706.

Figure 7C:
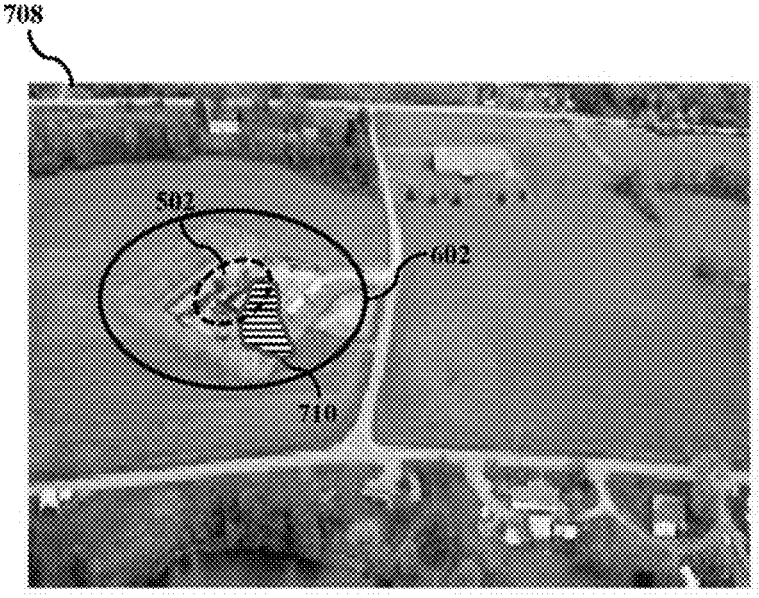
FIG. 7C illustrates another example spectrum image of the plot of land of FIG. 5B.

FIG. 7C illustrates another example spectrum image 708 of plot of land 500 of FIG. 5B. Spectrum image 708 includes an RGB image of well site 502, of well pad 602 and another spectrum image 710 of the gas flare in FIG. 7A at a time $t_1$.

In this example embodiment, let spectrum image 708 be an image within a higher portion of the infrared spectrum than the portion associated with spectrum image 706 discussed above with reference to FIG. 7B. In other words, the portion of the gas flare at time $t_1$ that is within a higher temperature range shows up as the portion within spectrum image 708.

Figure 7D:
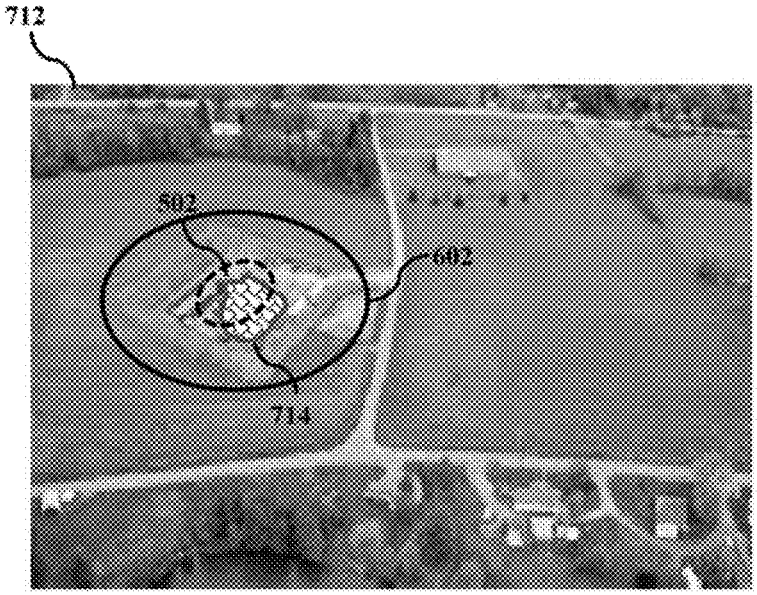
FIG. 7D illustrates another example spectrum image of the plot of land of FIG. 5B.

FIG. 7D illustrates another example spectrum image 712 of plot of land 500 of FIG. 5B. Spectrum image 712 includes an RGB image of well site 502, of well pad 602 and yet another spectrum image 714 of the gas flare in FIG. 7A at a time $t_1$.

In this example embodiment, let spectrum image 712 be an image within a higher portion of the infrared spectrum than the portion associated with spectrum image 710 discussed above with reference to FIG. 7C, in other words, the portion of the gas flare at time $t_1$ that is within an even higher temperature range shows up as the portion within spectrum image 712.

In this manner, multi-spectrum image 702 of a gas flare at time $t_1$ is a composite of spectrum image 706 of FIG. 7B, spectrum image 710 of FIG. 7C and spectrum image 714 of FIG. 7D. Further, a gas flare will have a different image at different times as a result of the flare changing shape and composition. This will be described with reference to FIG. 8.

Figure 8:
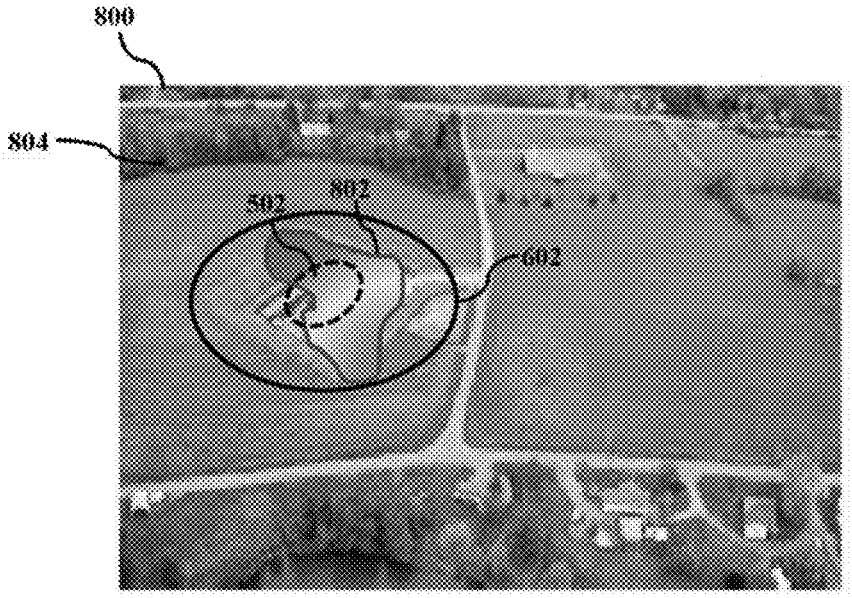
FIG. 8 illustrates another example multi-spectrum image of the plot of land of FIG. 5B at a time $t_2$.

FIG. 8 illustrates another example multi-spectrum image 800 of plot of land 500 of 5B, at a time $t_2$. In FIG. 8, a gas flare corresponds to an amount of gasses that are burned at well site 502 at time $t_2$.

As shown in FIG. 8, multi-spectrum image 800 includes an RGB image of well site 502, of well pad 602 and a multi-spectrum image 802 of a gas flare at a time $t_2$. Just as with FIGS. 7A-7D, in the example of FIG. 8, gasses that are burned may include a plurality of different flammable gasses that are extracted from well site 502. The each gas might burn at a different temperature, producing a specific signature, depending on the amount of each gas that is burned. In this case, the signature is different than that of FIG. 7A. Accordingly, with the multi-spectrum imaging aspect of the present invention, the different compositions of the gas that is burned in the gas flare may be remotely determined.

As seen in FIGS. 7A-8, well pad 602 is sufficiently lame so as to include the gas flares in FIGS. 7A and 8. Well pad 602 acts as a mask, preventing false positive identification of gas flare outside of well site 502. For example, suppose a tree 804 were to catch fire. The fire of tree 804 may generate imagery that may be similar to that of a gas flare. In such a case, if the fire of tree 804 were included as a gas flare, then any subsequent models of flared gas will be incorrect. For this reason, well pad 602 is chosen to be sufficiently large so as to include the most likely envisioned gas flares from well site 502, and sufficiently small to reduce the likelihood of non-gas flare thermal related events outside of well site 502.

Returning to FIG. 1, well site processor 114 generates well pad 602 for well site 502. Using the image data as provided by image data database 302 and well site data as provided by well site data database 304, as shown in FIG. 3, well site processor 114 is able to isolate the pixel data of well pad 602. More particularly, the data associated with pixels associated with a gas flare, for example as shown with reference to FIGS. 7A-D, are determined and provided to zonal statistics processor 116.

Zonal statistics processor 116 provides organizes the data of the pixels of the gas flare within well pad 602. In particular, zonal statistics processor 116 uses the location data of well pad 602 as a mask over image 500 to obtain data of the pixels within well pad 602. Of the pixels within well pad 602, those associated with a gas flare are counted. In an example embodiment, pixels may be determined to be associated with a gas flare based on at least one of the intensity and color of the pixel. In other words, zonal statistics processor 116 uses the pixel data from the image data receiving processor 404 and the well site data from well site data receiving processor 406 to generate pixel data associated with multi-spectrum image 702 of a gas flare at time $t_1$.

For example, pixels within spectral image 706 of FIG. 7B will have data associated with a flare at a particular temperature, pixels within spectral image 710 of FIG. 7C will have data associated with a flare at a particular temperature, pixels within spectral image 714 of 7D will have data associated with a flare at a particular temperature.

Returning to FIG. 2, after the pixel data of the well pad is found (S210), the well production data is received (S212). For example, FIG. 5B illustrates satellite image 500 with a well site 502. Here, the well site data identifies the location of well site 502 within satellite image 500. As noted above, the well pad includes well site 502.

As shown in FIG. 1, accessing processor 110 provides the received well production data to vent/flare processor 118 via communication channel 140. For example, as shown in FIG. 1 accessing processor 110 retrieves well production data from database 106. As shown in FIG. 3, database 106 provides the well production data from well production data database 306. As shown in FIG. 4, communication processor 402 receives the well production data from well production data database 306 and provides the well production data to well production data receiving processor 408 via communication channel 418. Returning to FIG. 1, well production data receiving processor 408 of accessing processor 110) then provides the well production data to vent/flare processor 118 via communication channel 140. Well production data receiving processor 408 (of accessing processor 110) additionally provides the well production data to regression processor 122 via communication channel 140.

In example method 200, well production data is received (S212) after the pixel data of the well pad is found (S210). It should be noted that in other non-limiting, example embodiments, the well production data may be received at any time after the method starts (S202) but prior to the calculation of the vent/flare volume (S214).

Returning to FIG. 2, after the well production data is received (S212), the vent/flare volume is determined (S214). For example, as shown in FIG. 1, vent/flare processor 118 uses the pixel data from the well pad and the well production data to calculate a vent/flare volume.

In some examples, zonal statistics processor 116 provides the pixel data of well pad 602 for a particular time to vent/flare processor 118 via communication channel 138. Further, accessing processor 110 provides a vein/flare volume from the well production data of the same time to vent/flare processor via communication channel 140. The pixel data of well pad 602 in conjunction with the vent/flare volume associated with the time of the pixel data enables vent/flare processor 118 to generate a vent/flare volume as a function of the pixel data associated with the imaged flare. By continuing to associate pixel data of well pad 602 at time periods with corresponding vent/flare volumes as provided by the well production data, the vent/flare volume as a function of the pixel data may become more reliable.

In other examples, a vent/flare volume as a function of the pixel data may be predetermined or provided by a third party. In such cases, this predetermined vent/flare volume as a function of the pixel data is stored in vent/flare processor 118.

In any event, once a vent/flare volume as a function of the pixel data is provided, vent/flare processor 118 may determine the volume of flared gases based on the image of the vent flare, i.e., based on the pixel data of well pad 602.

Vent/flare processor 118 then provides the vent/flare volume to capture/flare processor 120 via communication channel 142.

Returning to FIG. 2, after the vent/flare volume is determined (S214), the capture volume is determined (S216). For example, as shown in FIG. 1, capture/flare processor 120 uses the vent/flare volume from vent/flare processor 118 to calculate a capture volume.

There is a known functional relationship between the amount of gasses that are burned, in a gas flare and the volume of the captured crude at a well site. This will be described with reference to FIGS. 9-10.

Figure 9:
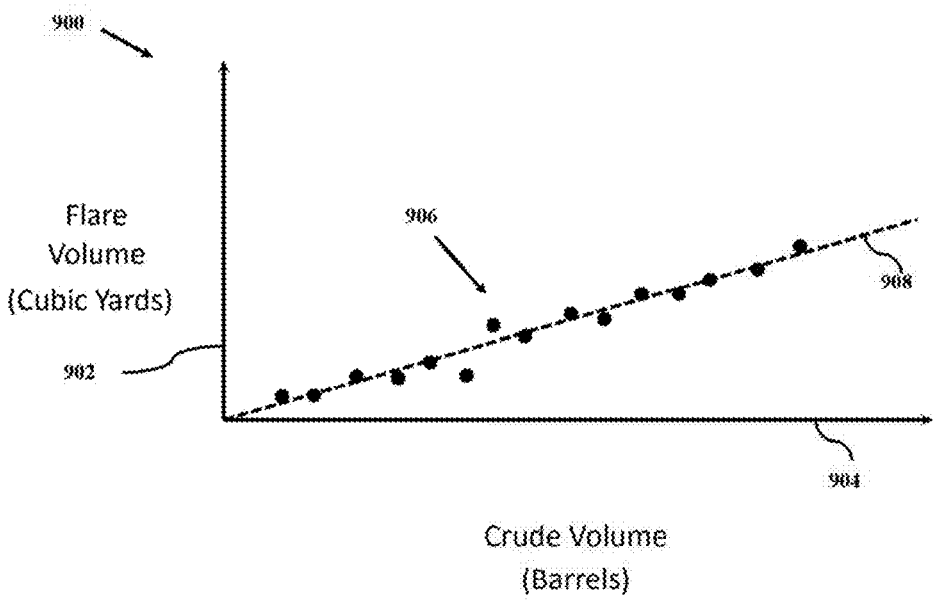
FIG. 9 illustrates a graph of flare volume in relation to captured crude volume.

FIG. 9 illustrates a graph 900 of flare volume in relation to captured crude volume.

As shown in the figure, graph 900 includes a y-axis 902 of flare volume in cubic yards, an x-axis 904 of captured crude volume in barrels, a plurality of samples indicated as plurality of dots 906 and a dotted line 908. Graph 900 corresponds to the extraction of crude and the corresponding flared gasses at an example well site. As shown by dotted line 908, the flare volume has linear relationship to the volume of captured crude.

Figure 10:
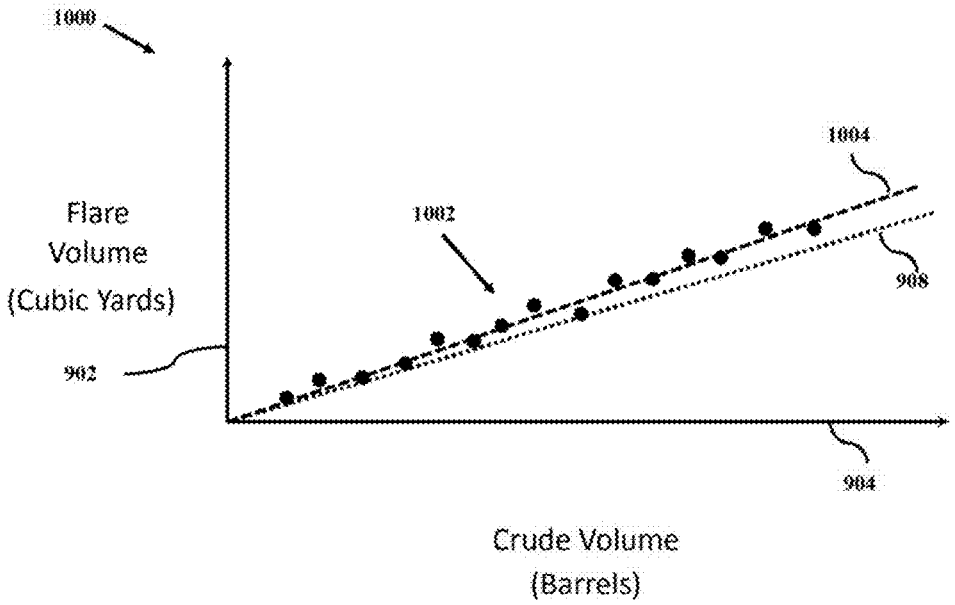
FIG. 10 illustrates another graph of flare volume in relation to captured crude volume.

FIG. 10 illustrates another graph 1000 of flare volume in relation to captured crude volume.

As shown in the figure, graph 1000 includes y-axis 902, x-axis 904, another plurality of samples indicated as plurality of dots 1002, a dashed line 1004 and dotted line 908. Graph 1000 corresponds to the extraction of crude and the corresponding flared gasses at another example well site. As shown by dotted line 1004, the flare volume has linear relationship to the volume of captured crude. Clearly, the volume of flared gases per barrel of captured crude at the example well site associated with FIG. 10 is higher than the volume of flared gases per barrel of captured crude at the example well site associated with FIG. 9. Nevertheless, there is a generally linear relationship between the volume of flared gasses per volume of captured crude at a well site.

In some instances, this linear relationship ma be determined by measuring the volume of flared gasses and the volume of captured crude at a well site over time. In other instances, this linear relationship may be provided as part of the well production data from well production data database 306.

Returning to FIG. 1, vent/flare processor 118 provides the vent/flare volume to capture/flare processor 120 via communication channel 142.

Once the linear relationship between the volume of flared gasses per volume of captured crude at a well site is provided, vent/flare processor 118 may determine the volume of captured crude at a well site based on the vent/flare volume.

Returning to FIG. 2, after the capture volume is determined (S216), it is determined whether the determined capture volume is the first determined capture volume (S218). For example, as shown in FIG. 1, regression processor 122 may have a counter register (not shown) that tracks the number of determined capture volumes.

If it is determined that the determined capture volume is the first determined capture volume (Yes at S218), then the process repeats (return to S204). Alternatively, if it is determined that the determined capture volume is not the first determined capture volume (No at S218), then multivariate regression is performed (return to S220). An example of a multivatiate regression will be further described with additional reference FIGS. 11A-16.

FIGS. 11A-D illustrate graphs of an example set of crude capture predictions in accordance with aspects of the present invention.

Figure 11A:
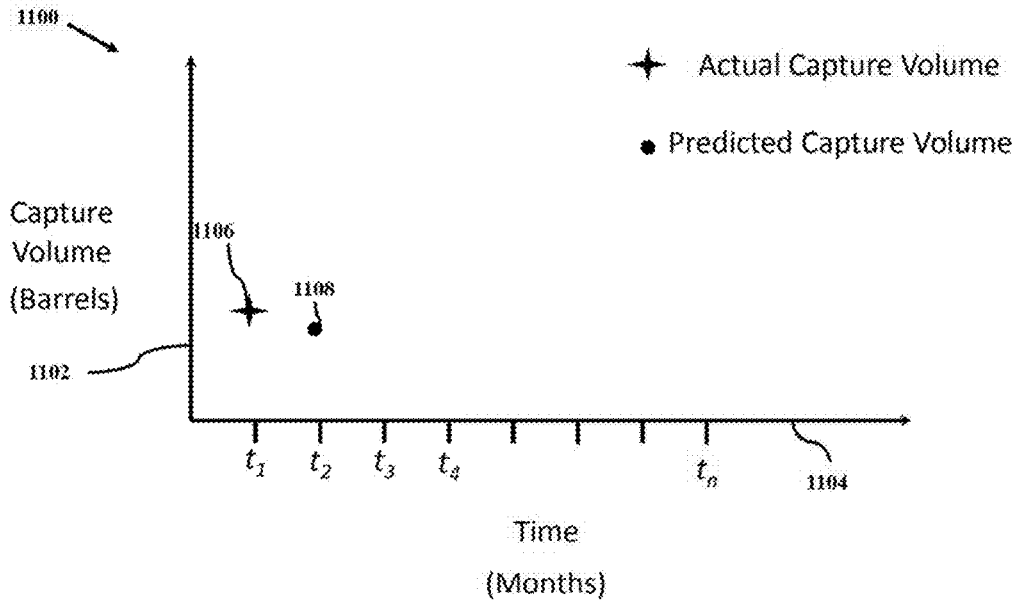
FIGS. 11A-D illustrate graphs of an example set of crude capture predictions in accordance with aspects of the present invention.

FIG. 11A includes a graph 1100 having a Y-axis 1102 and an X-Axis 1104. Y-axis 1102 is the crude capture volume, measured in barrels, and X-Axis 1104 is time, measured in months.

A star 1106 corresponds to the volume of crude captured from well site 502 at time $t_1$. A dot 1108 corresponds to the volume of crude, predicted after time $t_1$ and before time $t_2$, that is predicted to be captured from well site 502 at time $t_2$.

Returning to FIG. 1, vent/flare processor 118 uses the gas flare data of well site 602 from zonal statistics processor 116 and the known well production volume from accessing processor 110 and generates a monitored flare volume. In particular, each pixel will have a weighting factor associated with an amount of produced oil.

The weighting factors for each aspect of the well site data may be set in any known manner. The initial weighting factors settings are not particularly important as will be discussed later.

Vent/flare processor 118 then provides the monitored flare volume to capture/flare processor 120 via communication channel 142. Capture/flare processor 120 then estimates a capture volume.

In any event, returning to FIG. 11A, the weighting factors are used in conjunction with the provided data to generate a crude capture prediction at time $t_2$, as shown by dot 1108. The first prediction is after time $t_1$, such that the historical crude capture data from the volume of crude captured from well site 502 at time $t_1$ as shown by star 1106 may be used.

Returning to FIG. 2, after the crude capture prediction is generated (S216), it is determined whether the generated crude capture prediction is the first crude capture prediction (S218).

If the crude capture prediction is the first crude capture prediction (Y at S218), then image data is received (S204) at a later time in a manner as discussed above and method 200 continues.

A new crude capture prediction is then generated (S216) in a manner as discussed above. This new crude capture prediction will be described with reference to FIG. 11B.

Figure 11B:
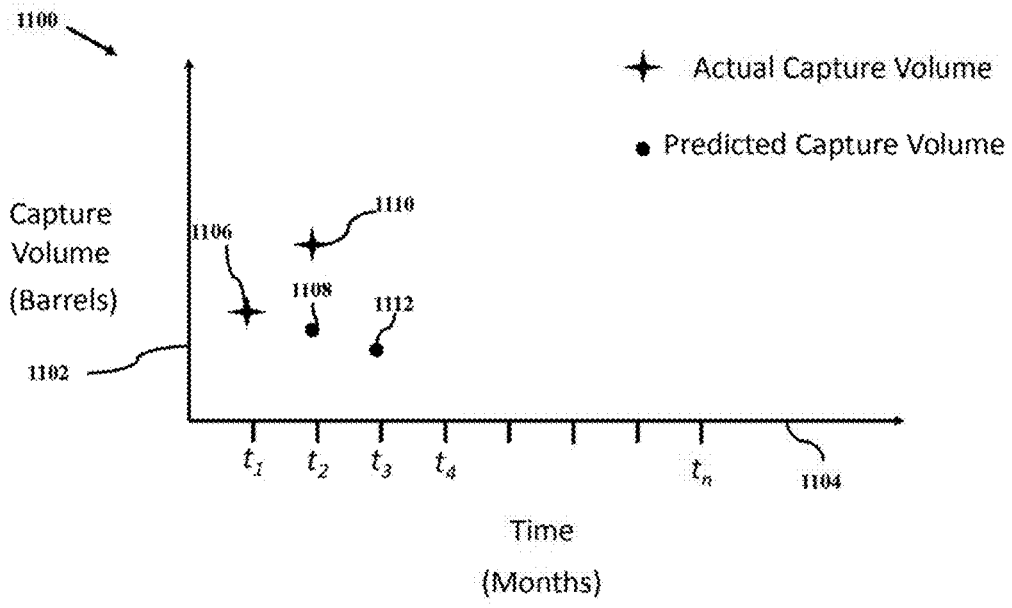

FIG. 11B includes graph 1100 with the addition of a star 1110 and a dot 1112.

Star 1110 corresponds to the volume of crude captured from well site 502 at time $t_2$. Dot 1112 corresponds to the volume of crude, predicted after time $t_2$ and before time $t_3$, that is predicted to be captured from well site 502 at time $t_3$.

Returning to FIG. 1, capture/flare processor 120 uses the vent/flare volume as provided by vent/flue processor 118 and generates a predicted volume of crude to be captured from well site 502. In this case however, the historical volume of crude captured from well site 502 will include the actual volume of crude captured from well site 502 associated with star 1106 at time $t_1$ and the actual volume of crude captured from well site 502 associated with star 1110 at time $t_2$.

Returning to FIG. 2, after the crude capture prediction is generated (S216), it is determined whether the generated crude capture prediction is the first crude capture prediction (S218). In this example, it will then be determined that the generated crude capture prediction is not the first crude capture prediction (N at S218).

Multivariate regression is then performed (S220). For example, as shown in FIG. 1, regression processor 122 receives the known well production volume from the well production data from accessing processor 110 via communication channel 140, receives the monitored flare volume generated by vent/flare processor and as provided by capture/flare processor 120 and receives the estimated capture volume from capture/flare processor 120 via communication channel 144. Regression processor 122 then and modifies the weighting factors to generate a more accurate prediction. This multivariate regression in accordance with aspects of the present invention provides an extremely efficient manner of arriving at an accurate prediction of a volume of captured crude. This will be described in greater detail with reference to FIGS. 8C-16.

First, there should be a discussion as to what would likely happen without a multivariate regression. This will be discussed with reference to FIGS. 1C-16.

Figure 11C:
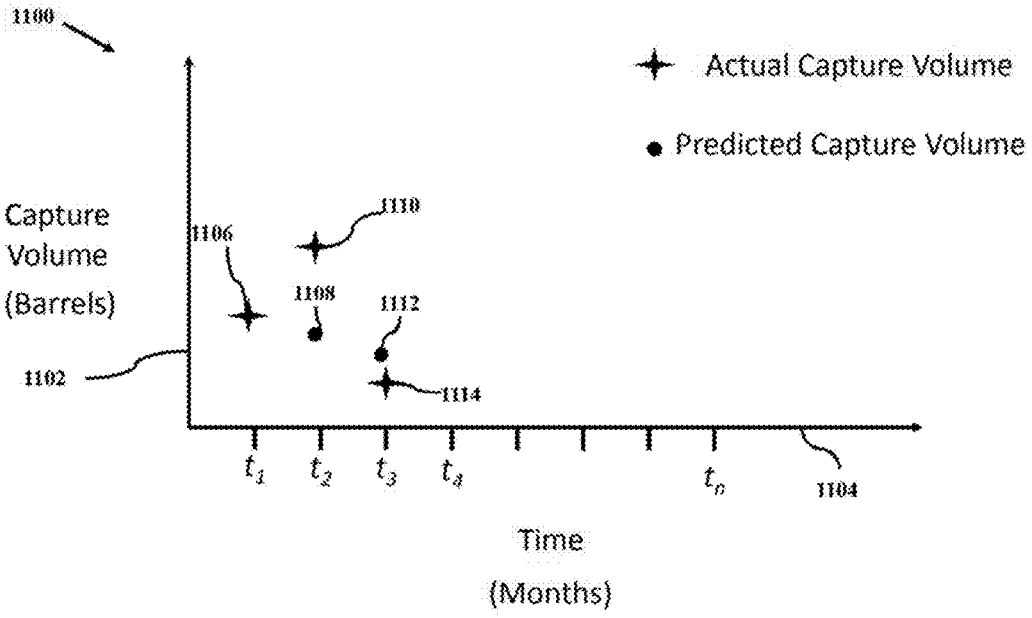

FIG. 11C includes graph 1100 with the addition a star 1114.

Star 1114 corresponds to the volume of crude captured from well site 502 at time $t_3$.

In this example, the weighting factors for each aspect of the well site data are set and are fixed. As shown in FIG. 11C, the resulting volume of crude that was predicted to be captured from well site 502 shown at dot 1108 differs greatly from the actual volume of crude captured from well site 502 shown at star 1110. However, the resulting volume of crude that was predicted to be captured from well site 502 shown at dot 1112 differs at a lesser amount from the actual volume of crude captured from well site 502 shown at star 1112. On its face, it seems that the predictions are becoming more accurate over time. This is not the case is this example, as will be shown in FIG. 11D.

Figure 11D:
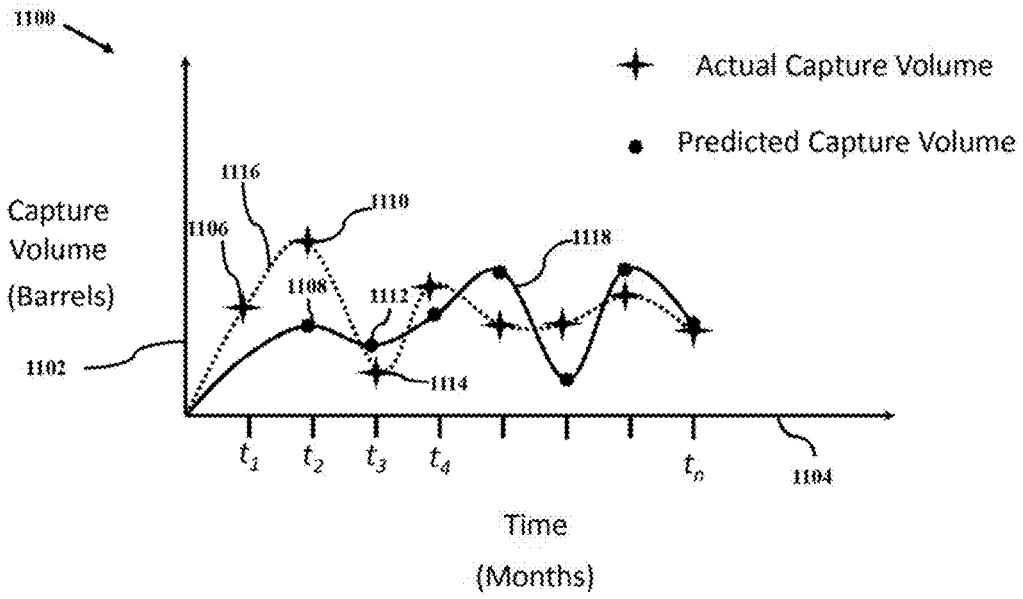

FIG. 11D includes graph 1100 with the addition of additional stars, additional dots, a dotted-line 1116 and a line 1118.

The additional stars correspond to the volume of crude captured from well site 502 at additional times. The additional dots correspond to the respective volumes of crude that are predicted to be captured from well site 502 at the additional times. Dotted-line 1116 shows a function of the actual crude captured from well site 502 by connecting the stars. Line 1118 shows a function of the crude predicted to be captured from well site 502 by connecting the dots.

It is clear in the figure that the captured crude predictions, as shown by line 1118 do not track the actual captured crude, as shown by line 1116, very well. This is due to the fixed weighting factors for each aspect of the well site data. By choosing or setting different fixed weighting factors will not solve the problem. This will be described with reference to FIG. 12.

Figure 12:
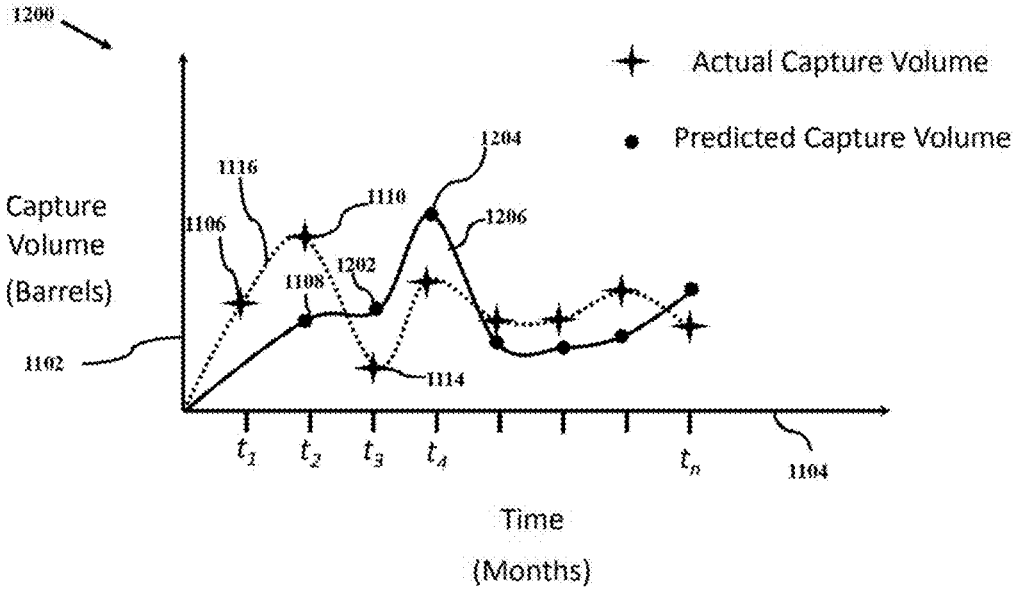
FIG. 12 illustrates a graph of another example set of crude capture predictions in accordance with aspects of the present invention.

FIG. 12 illustrates a graph of another example set of crude capture predictions in accordance with aspects of the present invention.

FIG. 12 includes a graph 1200 having Y-axis 1102 and X-Axis 1104. Graph 1200 additionally includes dot 1108, stars 1106, 1110, 1114, the remaining stars along dotted-line 1116, a dot 1202, a dot 1204, and additional dots along a line 1206.

Dot 1202 corresponds to the volume of crude, predicted after time $t_2$ and before time $t_3$, that is predicted to be captured from well site 502 at time $t_3$. Dot 1204 corresponds to the volume of crude, predicted after time $t_3$ and before time $t_4$, that is predicted to be captured from well site 502 at time $t_4$. The additional dots correspond to the respective volumes of crude are predicted to be captured from well site 502 additional times. Line 1206 shows a function of the crude predicted captured from well site 502 by connecting the dots.

It is clear in the figure that the captured crude predictions, as shown by line 1206 do not track the actual captured crude, as shown by line 1116, very well. Although the captured crude predictions in FIG. 12 are drastically different than the captured crude predictions in FIG. 11D, neither set of prediction is very accurate. This is due to the fixed weighting factors for each aspect of the well site data. The multivariate regression aspect of the present invention addresses this issue. This will be described with reference to FIGS. 13-16.

Figure 13:
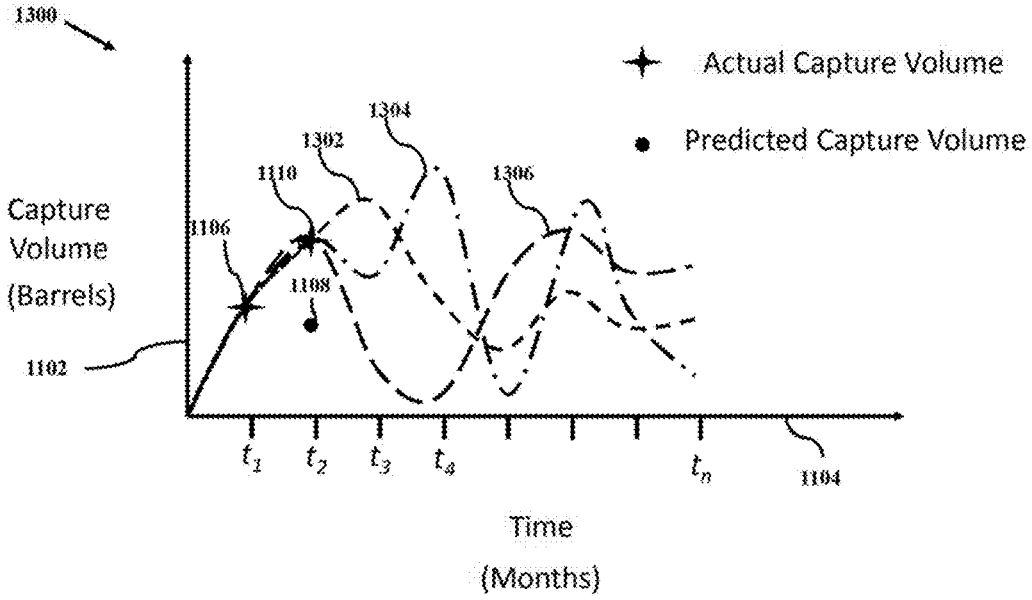
FIG. 13 illustrates a graph of another example set of crude capture predictions in accordance with aspects of the present invention.

FIG. 13 illustrates a graph of another example set of crude capture predictions in accordance with aspects of the present invention.

FIG. 13 includes a graph 1300 having Y-axis 1102 and X-Axis 1104. Graph 1300 additionally includes dot 1108, dot 1112, stars 1106 and 1110, 1114, a dashed line 1302, a dashed-dotted line 1304 and a dashed line 1306.

There are many functions for lines that pass through stars 1106 and 1110. A sample of such functions is illustrated as dashed line 1302, dashed-dotted line 1304 and dashed line 1306. Each function is created by modifying the many weighting factors for each aspect of the well site data. Clearly, as the weighting factors are changed, there are drastically different prediction models for predicting the volume of captured crude.

Returning to FIG. 1, in accordance with aspects of the present invention, regression processor 122 modifies the weighting factors to arrive at to new prediction function. The manner of modification may be any known manner. However, the modification to the weighting factors is likely to occur again, as will be further described with reference to FIG. 14.

Figure 14:
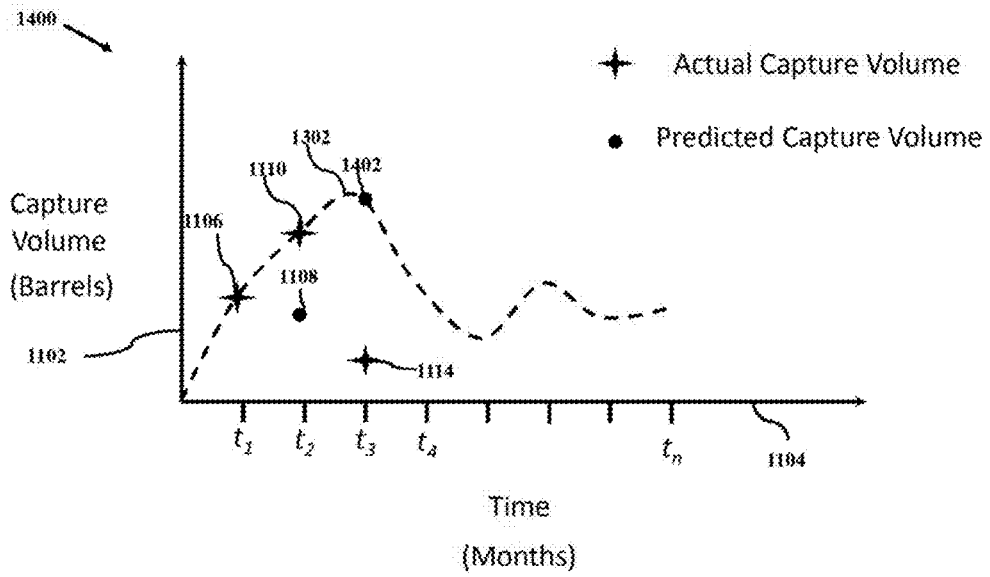
FIG. 14 illustrates a graph of another example crude capture prediction in accordance with aspects of the present invention.

FIG. 14 illustrates a graph of another example crude capture prediction in accordance with aspects of the present invention.

FIG. 14 includes a graph 1400 having Y-axis 1102 and X-Axis 1104. Graph 1400 additionally includes dot 1108, stars 1106, 1110, 1114, dashed line 1302 and a dot 1402.

In this example, regression processor 122 used dashed line 1302 to predict the crude capture volume. More particularly, regression processor 122 modified the many weighting factors for each aspect of the well site data such that the crude capture predictions would follow dashed line 1302. In this manner, the crude capture prediction at time $t_3$ would be at dot 1402 along dashed line 1302.

However, in this example, the actual crude capture volume at time $t_1$ is shown at star 1114. Clearly, the weighting factors assigned by regression processor 122 did not generate the correct crude capture volume predicting function. Returning to FIG. 2, method 200 continues as more and more estimates and actual crude capture volumes are used (return to S204).

Returning to FIG. 1, with data provided for each crude capture volume, regression processor 122 is able to update possible functions to predict future crude capture volumes. This is shown in FIG. 15.

Figure 15:
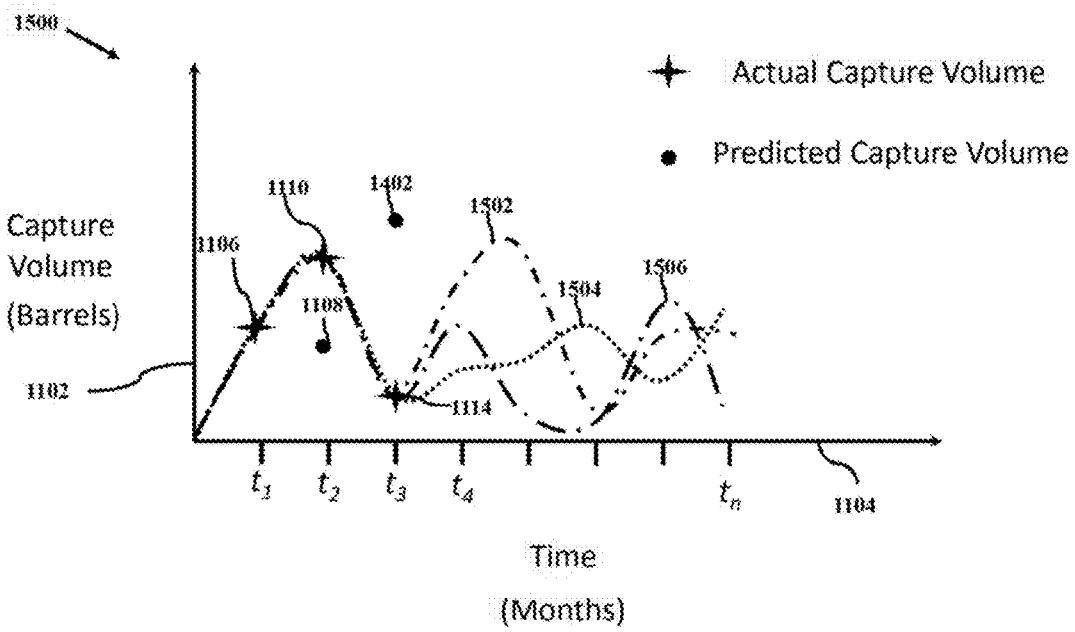
FIG. 15 illustrates a graph of another example crude capture prediction in accordance with aspects of the present invention.

FIG. 15 illustrates a graph of another example crude capture prediction in accordance with aspects of the present invention.

FIG. 15 includes a graph 1500 having Y-axis 1102 and X-Axis 1104. Graph 1500 additionally includes dot 1108, dot 1402, stars 1106, 1110, 1114, a dashed-dotted line 1502, a dotted line 1504 and a dashed-dotted line 1506.

Just as with FIG. 13 discussed above, there are many functions for lines that pass through stars 1106, 1110 and 1114. A sample of such functions is illustrated dashed-dotted line 1502, dotted line 1504 and dashed-dotted line 1506. Again, each function is created by modifying the many weighting factors for each aspect of the well site data. Clearly, as the weighting factors are changed, there are drastically different prediction models for predicting the volume of captured crude.

This loop of predicting a volume of captured crude based on modified weighting factors, receiving the actual volume of captured crude and further modifying the weighting factors to provide an improved prediction of the volume of captured crude continues. This will be shown with reference to FIG. 16.

Figure 16:
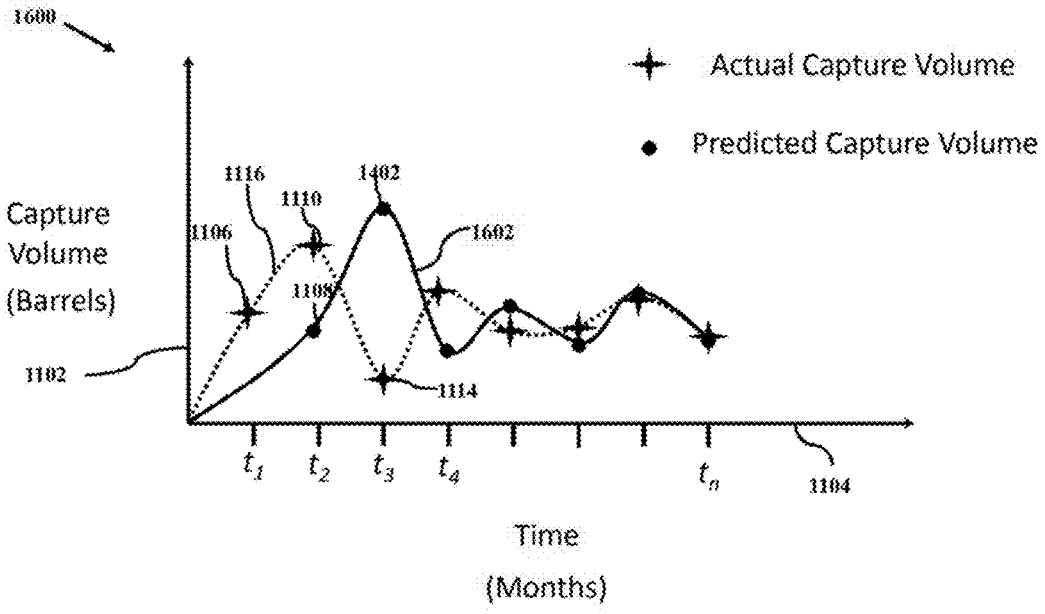
FIG. 16 illustrates a graph of another example crude capture prediction in accordance with aspects of the present invention.

FIG. 16 illustrates a graph of another example crude capture prediction in accordance with aspects of the present invention.

FIG. 16 includes a graph 1600 having Y-axis 1102 and X-Axis 1104. Graph 1600 additionally includes dot 1108, dot 1402, stars 1106, 1110, 1114, a plurality of additional stars connected by dotted line 1116 and plurality of additional dots connected by a line a line 1602.

In the figure, line 1602 shows the history of captured crude predications, whereas dotted line 1116 corresponds to the history of the actual volumes of captured crude. By comparing line 1602 with dotted line 1116, it is clear that line 1602 starts to track dotted line 1116 as time increases. In other words, in accordance with aspects of the present invention, a multivariate regression improves the prediction of volume of captured crude as time increases.

In accordance with aspects of the present invention, regression processor 122 modifies weighting factors to improve crude capture predictions. For example, consider FIGS. 5 and 7. Suppose, regression processor 122 may increase a weighting factor associated with a particular type of equipment used to collect crude at well site 502 and may decrease a weighting factor for a particular supervisor working at well site 502. In such a case, a new model for predicting collected crude volume at well site 502 may be produced.

In accordance with aspects of the present invention, a system and method predicting well site production is provided based on image data of the well site. A multivariate regression constantly improves the crude capture prediction based on actual previous crude volume that is captured.

In the drawings and specification, there have been disclosed embodiments of the invention and, although specific terms are employed, they are used in a generic and descriptive sense only and not for purposes of limitation, the scope of the invention being set forth in the following claims.

What is claimed as new and desired to be protected by Letters Patent of the United States is:

1. A device comprising:

an image data receiving processor having processor readable instructions therein so as to receive image data of a geographic region around and including a well site, the image data being a multi-spectrum image having information indicative of temperature;

a well site data receiving processor having processor readable instructions therein so as to receive well site location data of a location of the well site to analyze well site data to determine well pad location data of a location of a well pad including an area of observation extending beyond and around the well site;

a zonal statistics processor having processor readable instructions therein so as to receive the well pad location data of the well pad to determine pixel data of the well pad within the image data for a particular time from the well pad location data; and a vent flare calculator having processor readable instructions therein so as to analyze the pixel data of the well pad with a flare volume to pixel data function for a particular time to determine a volume of flared gas based on the pixel data.

2. The device of claim 1, further comprising a well production data receiving processor having readable instructions therein so as to receive well production data of the well site.

3. The device of claim 2, further comprising a capture calculator having processor readable instructions therein so as to determine a crude production volume based on the determined volume of flared gas and the well production data of the well site.

4. The device of claim 3, further comprising a multivariate regression processor having processor readable instructions therein so as to generate a crude volume function corresponding to the volume of crude oil as a function of time based on the well production data of a first time, the determined volume of flared gas at a second time and the determined crude production volume.

5. The device of claim 4, wherein said multivariate regression processor has processor readable instructions therein so as to further generate a flared gas function corresponding to the volume of flared gas as a function of time based on the well production data of the first time, the determined volume of flared gas at the second time and the determined crude production volume.

6. The device of claim 3, further comprising a multivariate regression processor having processor readable instructions therein so as to generate a flared gas function corresponding to the volume of flared gas as a function of time based on the well production data of the first time, the determined volume of flared gas at the second time and the determined crude production volume.

7. The device of claim 1, wherein said image data receiving processor has processor readable instructions therein so as to receive image data as infrared image data of the geographic region.

8. A method comprising:

receiving, via an image data receiving processor, image data of a geographic region around and including a well site, the image data being a multi-spectrum image having information indicative of temperature;

receiving, via a well site data receiving processor, well site location data of a location of the well site;

generating, via the well site data receiving processor, well pad location data of a location of a well pad including an area of observation extending beyond and around the well site;

determining, via a zonal statistics processor, pixel data of the well pad from the image data for a particular time from the well pad location data; and determining, via a vent flare calculator, a volume of flared gas based on the pixel data of the well pad with a flare volume to pixel data function to assist in predicting well site production.

9. The method of claim 8, further comprising receiving, via a well production data receiving processor, well production data of the well site.

10. The method of claim 9, further comprising determining, via a capture calculator, a crude production volume based on the determined volume of flared gas and the well production data of the well site.

11. The method of claim 10, further comprising generating, via a multivariate regression processor, a crude volume function corresponding to the volume of crude oil as a function of time based on the well production data of the first time, the determined volume of flared gas at the second time and the determined crude production volume.

12. The method of claim 11, further comprising generating, via the multivariate regression processor, a flared gas function corresponding to the volume of flared gas as a function of time based on the well production data of the first time, the determined volume of flared gas at the second time and the determined crude production volume.

13. The method of claim 10, further comprising generating, via a multivariate regression processor, a flared gas function corresponding to the volume of flared gas as a function of time based on the well production data of the first time, the determined volume of flared gas at the second time and the determined crude production volume.

14. The method of claim 8, wherein said receiving, via an image data receiving processor, image data of a geographic region around and including a well site comprises receiving the image data as infrared image data of the geographic region.

* * * * *